US006983865B2

(12) United States Patent
Cabarroque et al.

(10) Patent No.: US 6,983,865 B2
(45) Date of Patent: Jan. 10, 2006

(54) FLUID DISPENSER DEVICE

(75) Inventors: Xavier Cabarroque, Le Kremelin-Bicetre (FR); Fabien Poulard, Rouen (FR)

(73) Assignee: Valois SAS, Le Neubourg (FR)

( * ) Notice: Subject to any disclaimer, the term of this patent is extended or adjusted under 35 U.S.C. 154(b) by 208 days.

(21) Appl. No.: 10/417,210

(22) Filed: Apr. 17, 2003

(65) Prior Publication Data

US 2004/0026453 A1 Feb. 12, 2004

Related U.S. Application Data

(60) Provisional application No. 60/382,045, filed on May 22, 2002.

(30) Foreign Application Priority Data

Apr. 17, 2002 (FR) ..... 02 04810

(51) Int. Cl.
*B67D 5/40* (2006.01)

(52) U.S. Cl. ..... 222/153.13; 222/153.14; 222/182; 222/321.8

(58) Field of Classification Search ..... 222/153.13, 222/153.14, 182, 321.1, 321.8
See application file for complete search history.

(56) References Cited

U.S. PATENT DOCUMENTS

| | | | | |
|---|---|---|---|---|
| 4,834,083 A * | 5/1989 | Byram et al. | ..... | 222/402.13 |
| 5,465,873 A | 11/1995 | Mejean et al. | | |
| 5,649,645 A * | 7/1997 | Demarest et al. | ..... | 222/153.13 |
| 5,875,932 A * | 3/1999 | Meshberg | ..... | 222/153.13 |

FOREIGN PATENT DOCUMENTS

| | | |
|---|---|---|
| FR | 2 750 460 A | 1/1998 |
| WO | WO 01 03851 A | 1/2001 |

* cited by examiner

*Primary Examiner*—Kenneth Bomberg
(74) *Attorney, Agent, or Firm*—Sughrue Mion, PLLC

(57) ABSTRACT

A manually-actuated device for dispensing a fluid in liquid or powder form and that comprises a fluid reservoir (10), dispensing means (20) for selectively dispensing the fluid contained in the reservoir (10), a dispensing head (30) provided with a dispensing orifice (31), and an actuating system (40) for manually actuating said dispensing means (20), said device being provided with a cap (50) mounted to move between a rest position, in which it covers the dispensing orifice (31) and prevents the dispensing means (20) from being actuated, and an in-use position, in which it uncovers the dispensing orifice (31) and enables the dispensing means (20) to be actuated, characterized in that said cap (50) is a captive cap and is independent from the actuating system (40).

15 Claims, 8 Drawing Sheets

FLUID DISPENSER DEVICE

CROSS REFERENCE TO RELATED APPLICATION

This application claims the benefit under 35 U.S.C. §119 (e) of pending U.S. provisional patent application Ser. No. 60/382,045, filed May 22, 2002, and priority under 35 U.S.C. §119(a)–(d) of French patent application No. FR-02.04810, filed Apr. 17, 2002.

TECHNICAL FIELD

The present invention relates to a manually-actuated device for dispensing fluids in liquid or powder form.

BACKGROUND OF THE INVENTION

A liquid or powder dispenser device, in particular for dispensing fluids in the fields of pharmaceuticals, cosmetics, perfumes or the like, generally comprises a fluid reservoir, a dispensing member, such as a pump, for dispensing the fluid contained in the reservoir, and a dispensing head incorporating a dispensing orifice. An actuating system is generally also provided for actuating said pump. A problem that can arise with liquid or powder dispenser devices of this type relates to the period of time that elapses between the end of the device being assembled, and the occasion on which the user actually uses it. During that time lapse, it is necessary to prevent the dispensing orifice from becoming clogged or soiled, and to prevent the device from being actuated accidentally. Those problems are generally solved by providing a removable cap on the dispensing head, and a system for locking the device, which system prevents any accidental actuation of the device. For example, that may be achieved by means of a break-off strip or by means of a latch element to be moved out of the way prior to use. Although such systems are effective, they suffer from some drawbacks. The removable cap might be lost when it is removed from the dispensing head, so that the problem of the dispensing orifice becoming clogged can then arise after the first occasion on which the device is used, e.g. when the dispenser device is to be carried about in a handbag or the like. Similarly, safety systems for preventing the device from being actuated accidentally while it is being stored or carried can be complex and therefore costly to make, and they are not always entirely reliable.

BRIEF SUMMARY OF THE INVENTION

An object of the present invention is to provide a liquid or powder dispenser that does not suffer from the above-mentioned drawbacks.

An object of the present invention is thus to provide a liquid or powder dispenser that protects the dispensing orifice and that simultaneously prevents the device from being actuated at any time in the periods during which the device is not in use.

Another object of the present invention is to provide a liquid or powder dispenser device that is simple and inexpensive to manufacture and to assemble, and that is easy to use.

The present invention thus provides a manually-actuated device for dispensing a fluid in liquid or powder form and that comprises a fluid reservoir, dispensing means for selectively dispensing the fluid contained in the reservoir, a dispensing head provided with a dispensing orifice, and an actuating system for manually actuating said dispensing means, said device being provided with a cap mounted to move between a rest position, in which it covers the dispensing orifice and prevents the dispensing means from being actuated, and an in-use position, in which it uncovers the dispensing orifice and enables the dispensing means to be actuated, said cap being a captive cap and being independent from the actuating system.

In a first variant embodiment, said device is provided with locking means for locking the dispensing means, which locking means prevent said dispensing means from being actuated, said cap moving and/or deforming said locking means when it is moved into its in-use position to enable the dispensing means to be actuated.

Advantageously, said locking means are resilient tabs which, when the cap is in the rest position, prevent the dispensing head and the reservoir from moving relative to each other, said tabs being deformed by the cap when it is in the in-use position.

Advantageously, said cap comprises a substantially cylindrical body that surrounds the dispensing head when the cap is in the rest position, and a cover mounted to move relative to said body, said cover being opened by the user firstly to uncover the dispensing orifice, and secondly to move said cover into its in-use position.

Advantageously, said cap is moved axially in translation and/or in rotation relative to said dispensing head.

In a second variant embodiment, when the cap is in the rest position, it covers the actuating system, thereby preventing access to said actuating system.

Advantageously, said cap comprises a substantially cylindrical body which, when the cap is in the rest position, surrounds the dispensing head and the actuating system, and a cover mounted to move relative to said body, said cover opening automatically to uncover the dispensing orifice when the user moves said cap towards its in-use position.

Advantageously, said cap is moved in rotation about said dispensing head and about said actuating system, this movement in rotation causing said cap to be moved axially relative to said dispensing head.

Advantageously, said actuating system comprises a side actuating element, said cap having a side wall covering said side actuating element when said cap is in the rest position.

Advantageously, said dispensing means are implemented in the form of a pump that is actuated manually.

In another embodiment, said dispensing means comprise piezoelectric or electrostatic spray means, the device including electronic means for enabling and/or for disabling actuation of said dispensing means, said electronic means being activated and/or deactivated by said cap.

Advantageously, locking elements co-operate with the actuating system, said locking elements being mounted to move between an locking position and a release position, and being moved between these positions by said electronic means.

Advantageously, said locking elements are tabs for locking the actuating button of the device, said electronic means comprising a contactor that comes into contact with the captive cap when said cap is in the in-use position, said contactor causing said tabs to move into their release position when it is contact with said captive cap.

BRIEF DESCRIPTION OF THE DRAWINGS

Other characteristics and advantages of the invention will appear more clearly on reading the following detailed description of various embodiments of the invention, given with reference to the accompanying drawings which are given by way of non-limiting example, and in which.

DETAILED DESCRIPTION

Figure 1:
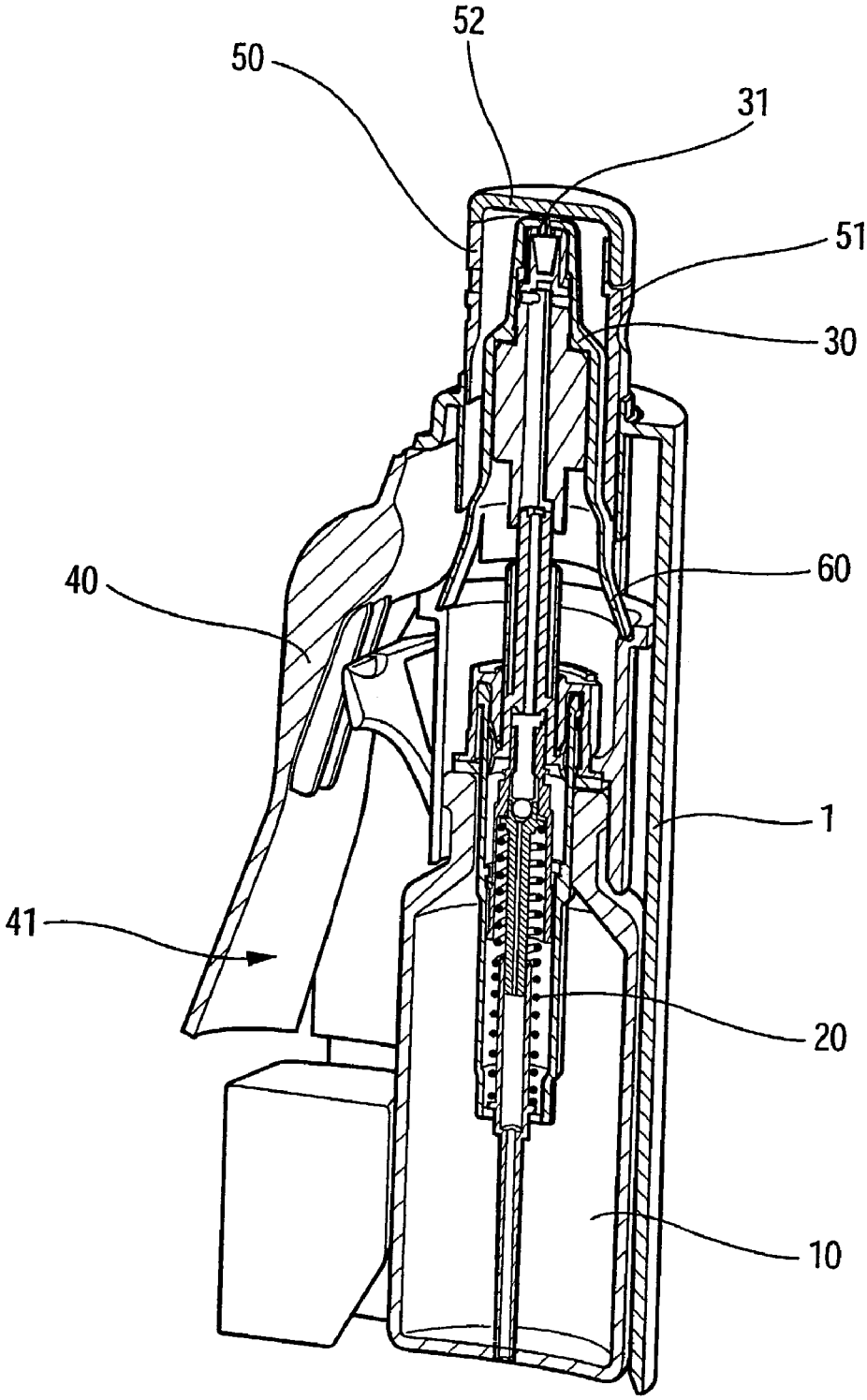
FIG. 1 is a partially cut-away diagrammatic perspective view of a liquid or powder dispenser device in a first embodiment of the present invention, with the cap in the rest position.

With reference to FIGS. 1 to 6, the device of the invention for dispensing a fluid in liquid or powder form comprises a fluid reservoir 10 on which a dispensing pump 20 is assembled, the dispensing pump itself being connected to a dispensing head 30 provided with a dispensing orifice 31. An actuating system 40 is provided for actuating said pump 20. In the invention, the device includes a captive cover 50 which is mounted to move between a rest position (shown in FIGS. 1 and 4) in which it covers the dispensing orifice 31 and prevents the pump 20 from being actuated, and an in-use position (shown in FIGS. 3 and 6) in which it uncovers the dispensing orifice 31 and enables the pump 20 to be actuated. By captive cap, we mean a cap which is fixed or linked to the dispensing device at any moment and in any position.

FIGS. 1 to 6 show two embodiments of the invention. According to the invention, the cap 50 is independent from the actuating system 40. In other words, it is not on the cap 50 that the user exerts a force to actuate the pump.

Figure 2:
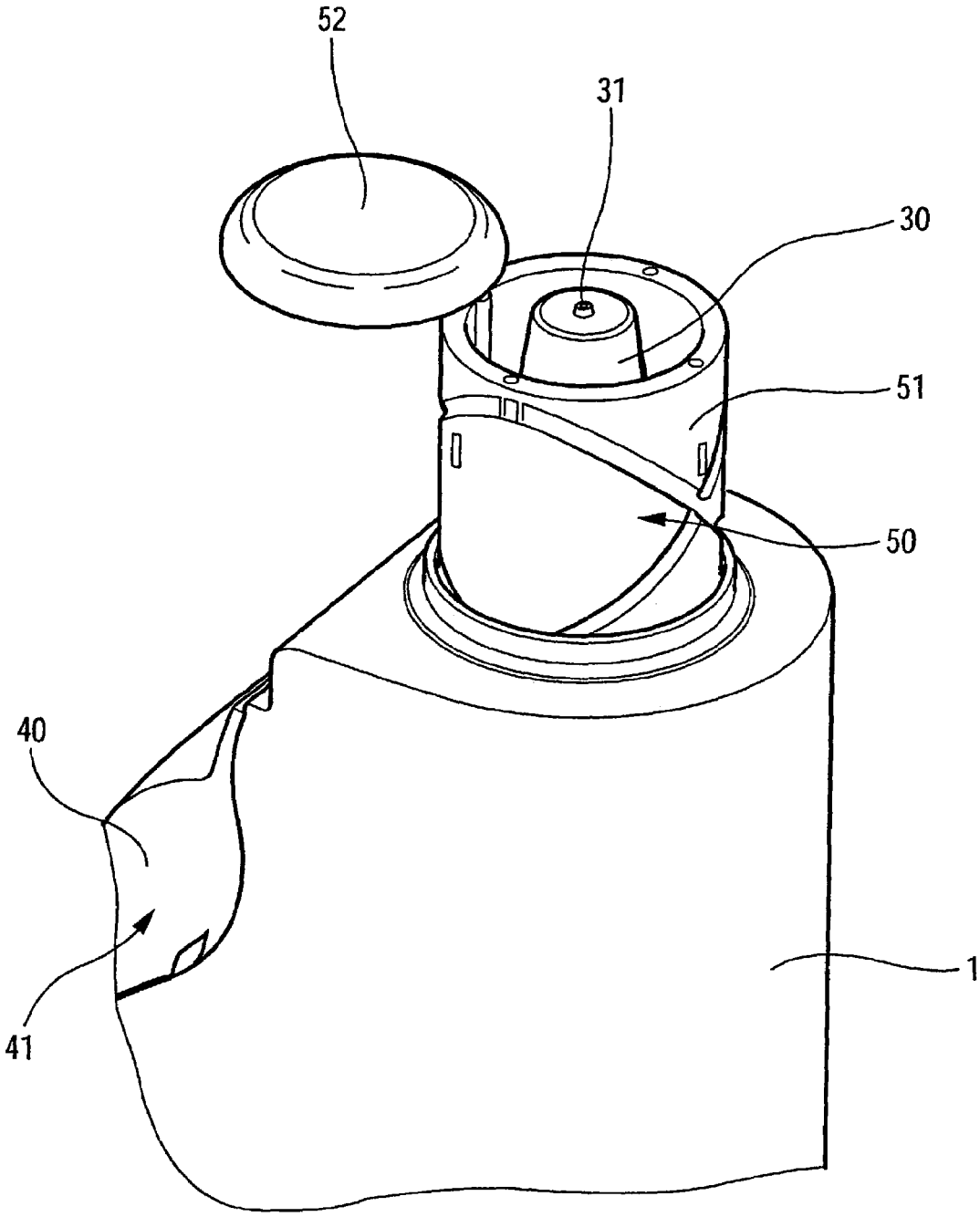
FIG. 2 is a detail view of the cap of the device of FIG. 1, in an intermediate position.
Figure 3:
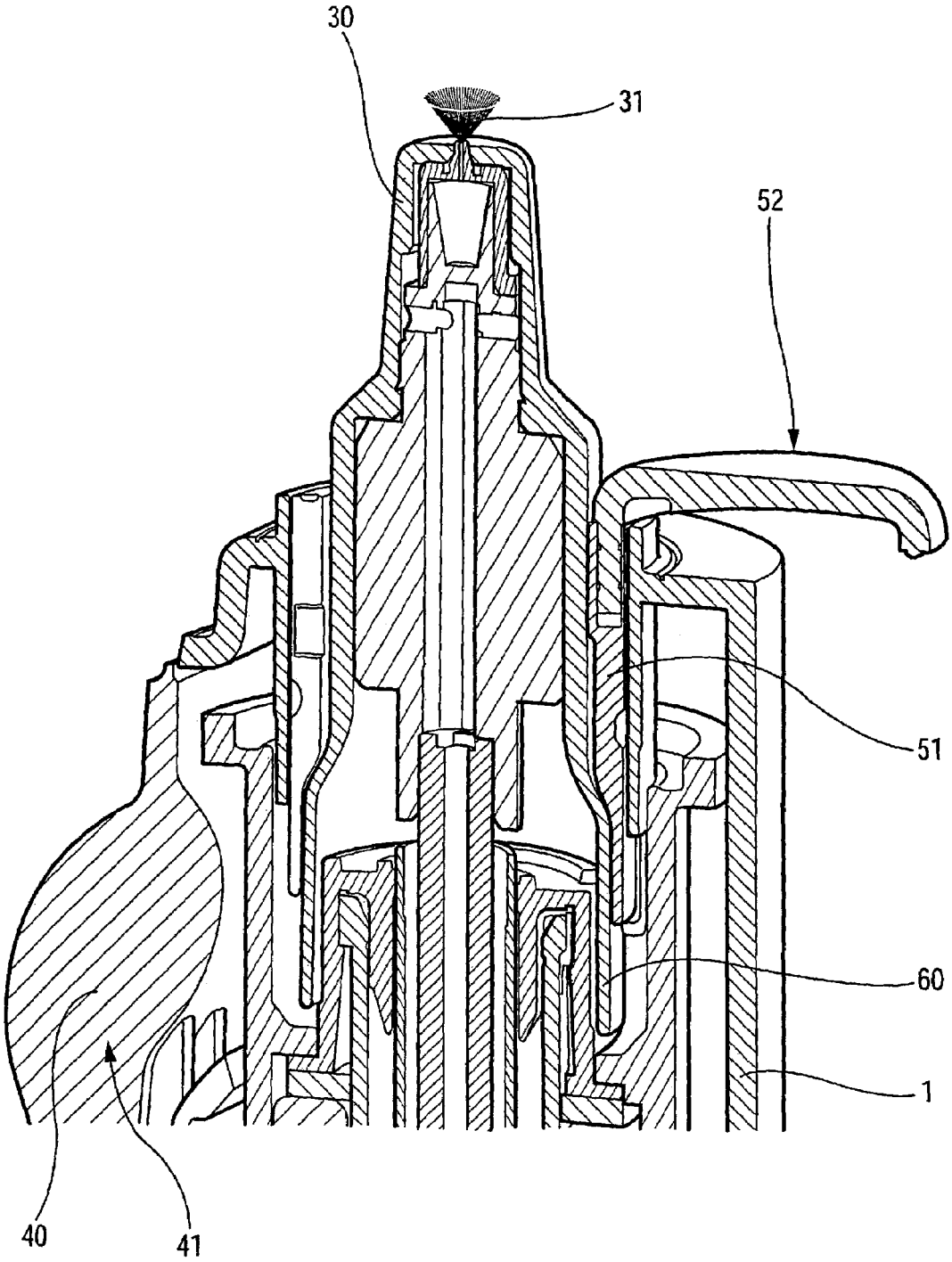
FIG. 3 is a diagrammatic view of said first embodiment, with the cap in the in-use position.

FIGS. 1 to 3 show a first variant embodiment of such a system, in which the dispensing device is provided with locking means 60 for locking the pump 20. The locking means prevent the pump from being actuated when the cap 50 is in the rest position. By being moved into its in-use position, the cap 50 moves and/or deforms said locking means 60 to enable the pump to be actuated by means of the actuating system 40. The locking means 60 may be implemented in the form of resilient tabs, as shown in FIGS. 1 and 3. When the cap 50 is in its rests position, said tabs 60 prevent the dispensing head 30 and the reservoir 10 from moving relative to each other, and thereby prevent the pump 20 from being actuated. Advantageously, said tabs 60 may be secured to or integral with the head 30. In the embodiment shown in FIGS. 1 to 3, the cap 50 includes a body 51 that is substantially cylindrical and that surrounds the dispensing head 30 when the cap is in the rest position. The cap 50 further includes a cover 52 which is mounted to move relative to said body 51 of the cap, said cover 52 being opened by the user firstly to uncover the dispensing orifice 31, as shown in FIG. 2, and secondly to make it possible to move said cap 50 into its in-use position, shown in FIG. 3. The cap 50 may be moved into its in-use position by causing the body 51 of the cap to turn about the head 30, or, in a variant, by pressing on said cover 52. Advantageously, said cap 50 may be provided with one or more grooves in its side wall that forms the body 51, said grooves being suitable for guiding the cap as it moves towards its in-use position. With reference to FIG. 2, the cap-50 is provided with two slanting grooves that co-operate with corresponding ribs that are integral with the dispenser device, and that are such that, when the user wishes to move the cap 50 towards its in-use position, the cap turns about the dispensing head 30 while moving axially in translation relative thereto to reach the position shown in FIG. 6. It should be noted that the cap can be turned in either direction, and that either the cap 50 or the body 1 of the dispenser may be turned, or indeed both of them may be turned. In the in-use position shown in FIG. 3, the body 51 of the cap 50 has moved and/or deformed the resilient tabs 60 that were preventing the pump from being actuated, so that, by actuating the actuating system 40, the user can dispense a dose of fluid. In the example shown, the actuating system 40 is formed by a pivotally-mounted side actuating lever 41, but any other equivalent actuating system could be devised.

Figure 4:
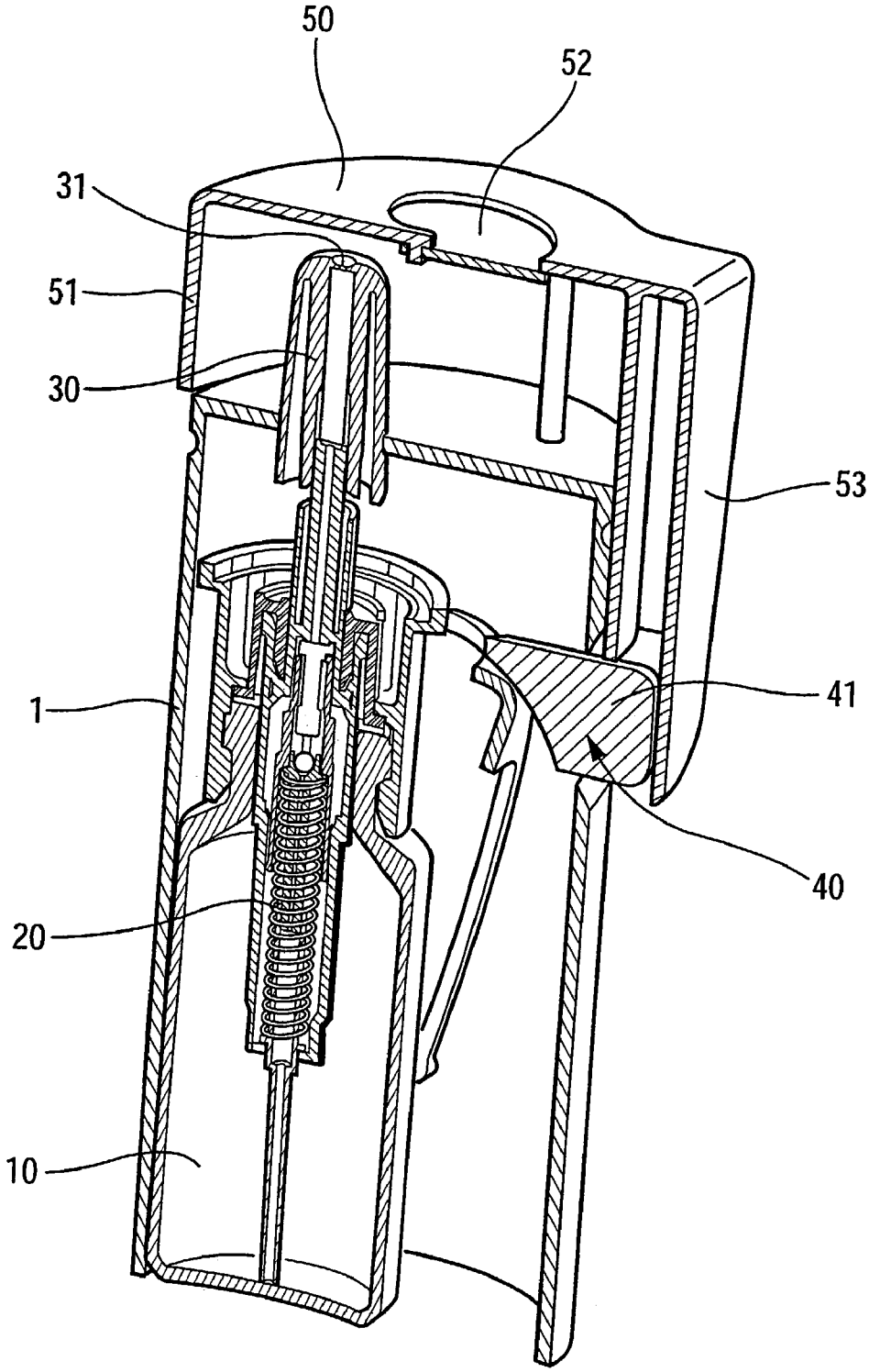
FIG. 4 is a partially cut-away diagrammatic perspective view of a dispenser device in a second embodiment of the present invention, with the cap in the rest position.
Figure 5:
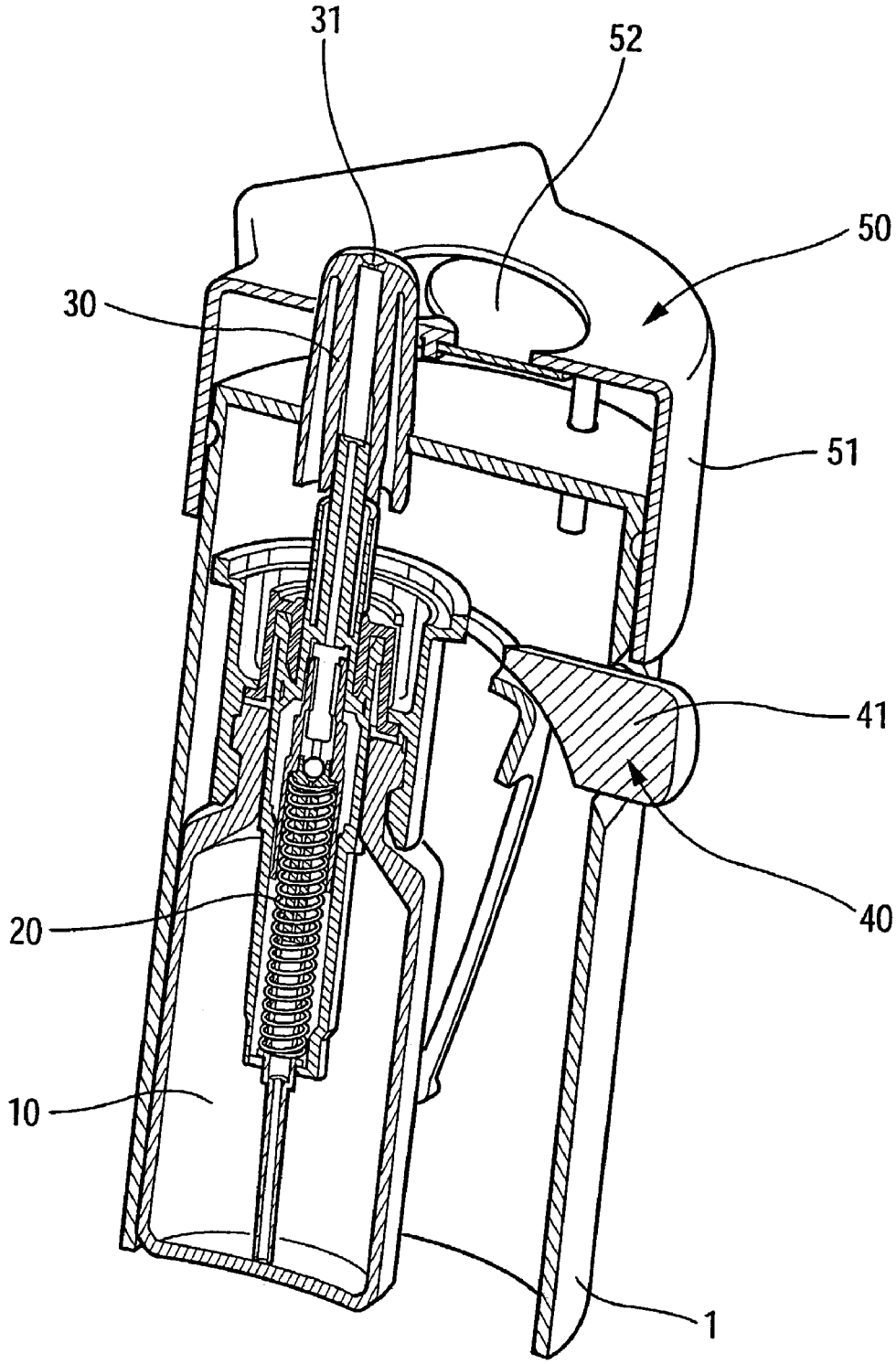
FIG. 5 is a view similar to the FIG. 4 view, with the cap in the intermediate position.
Figure 6:
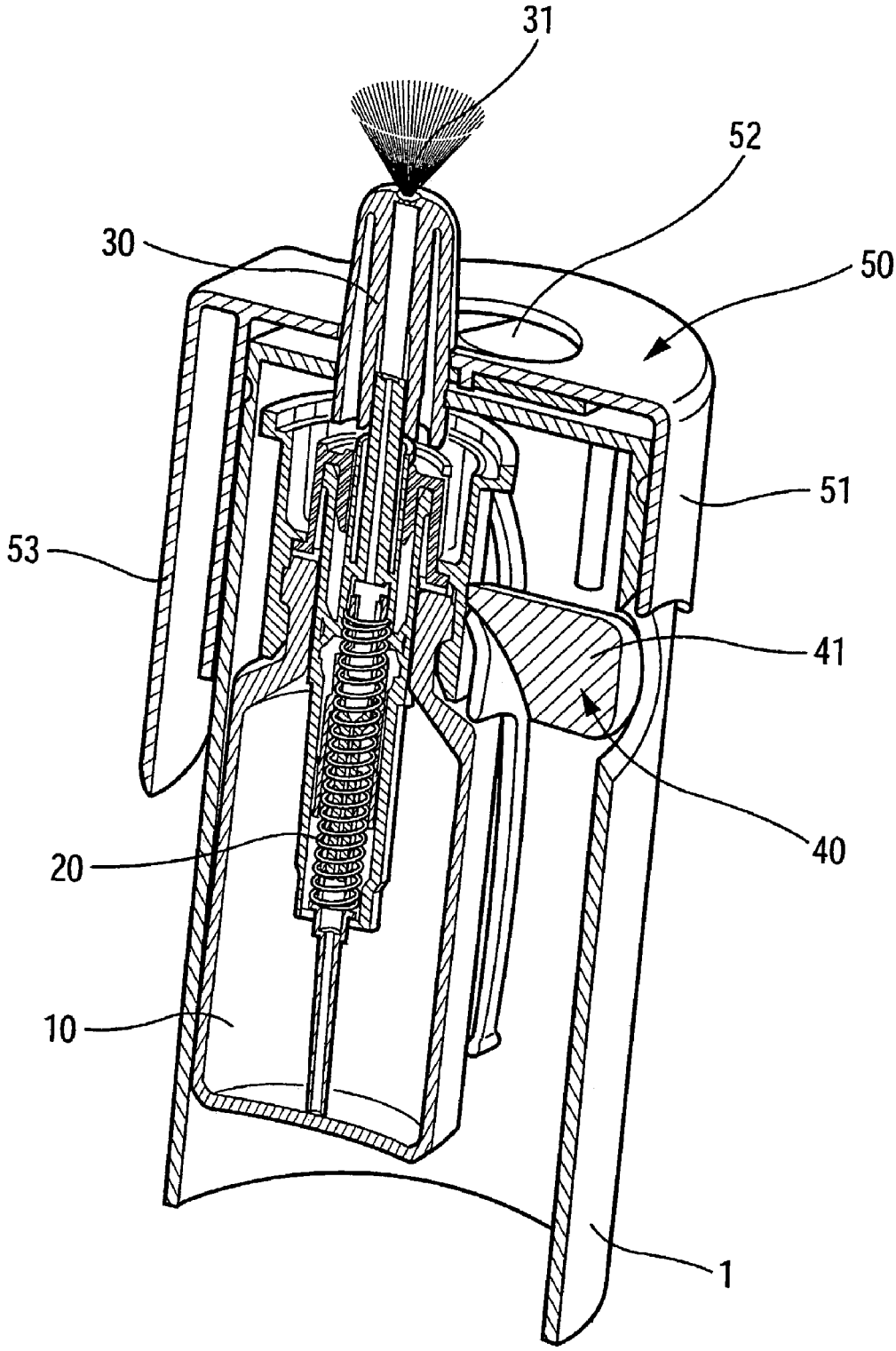
FIG. 6 is a view similar to the views of FIGS. 4 and 5, with the cap in the in-use position.
Figure 8:
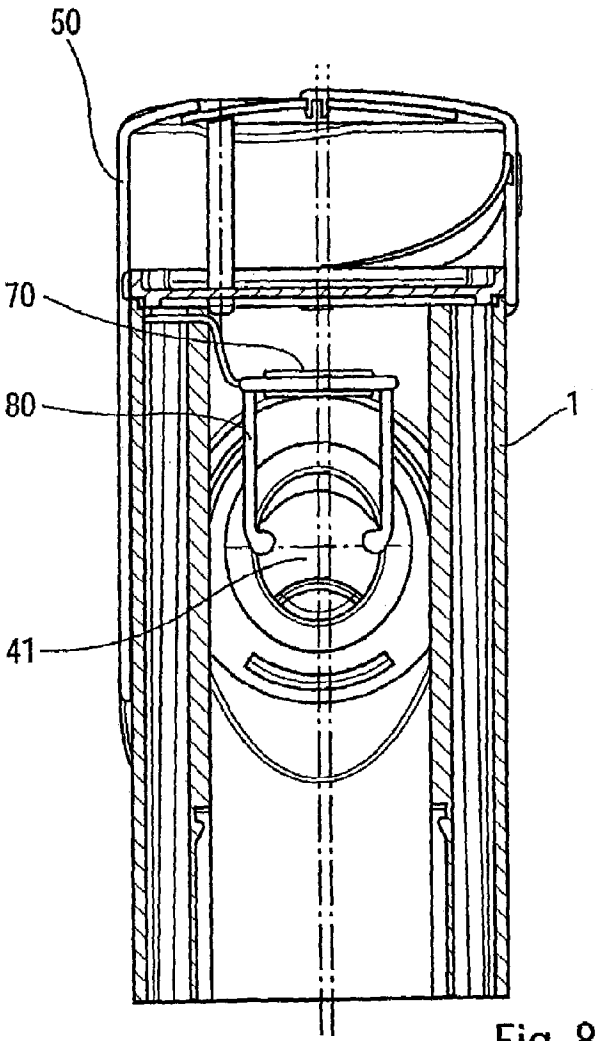
FIG. 8 is a view on section D—D of FIG. 7.
Figure 7:
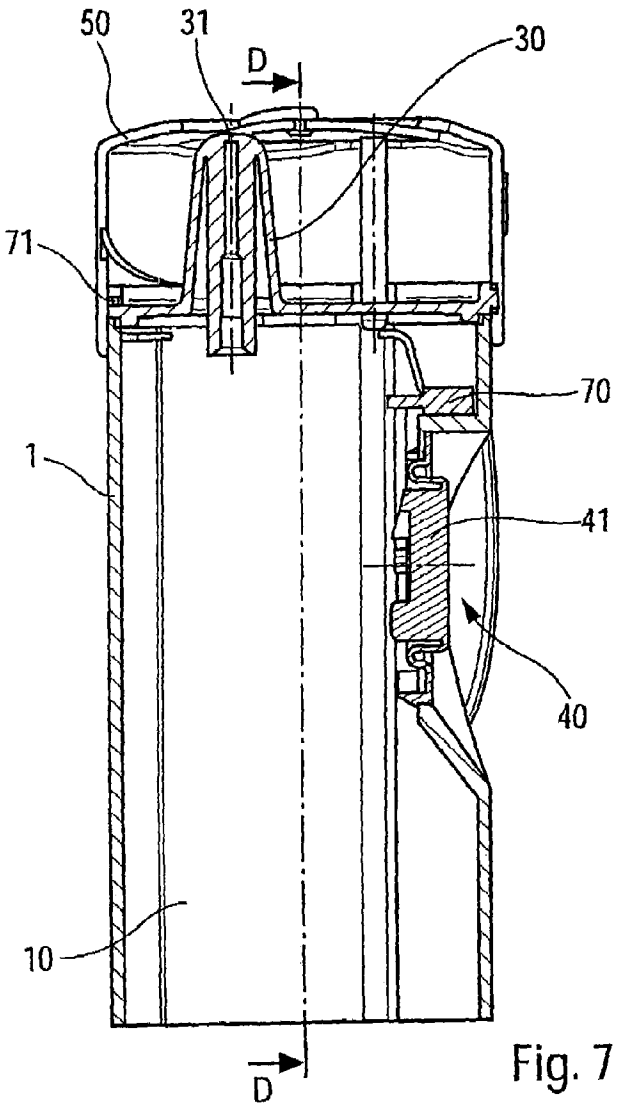
FIG. 7 is a diagrammatic view of another embodiment of the invention, with the cap in the rest position.
Figure 10:
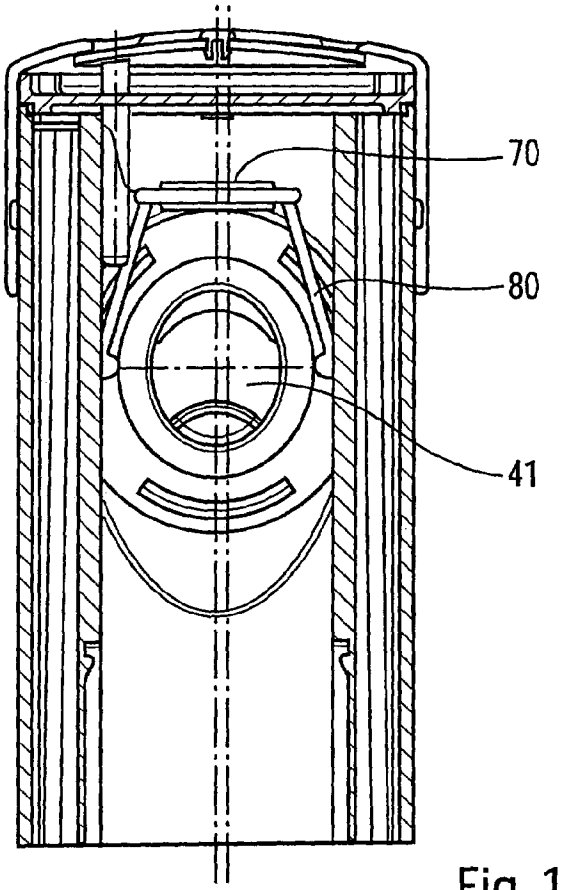
FIG. 10 is a view on section D—D of FIG. 9.
Figure 9:
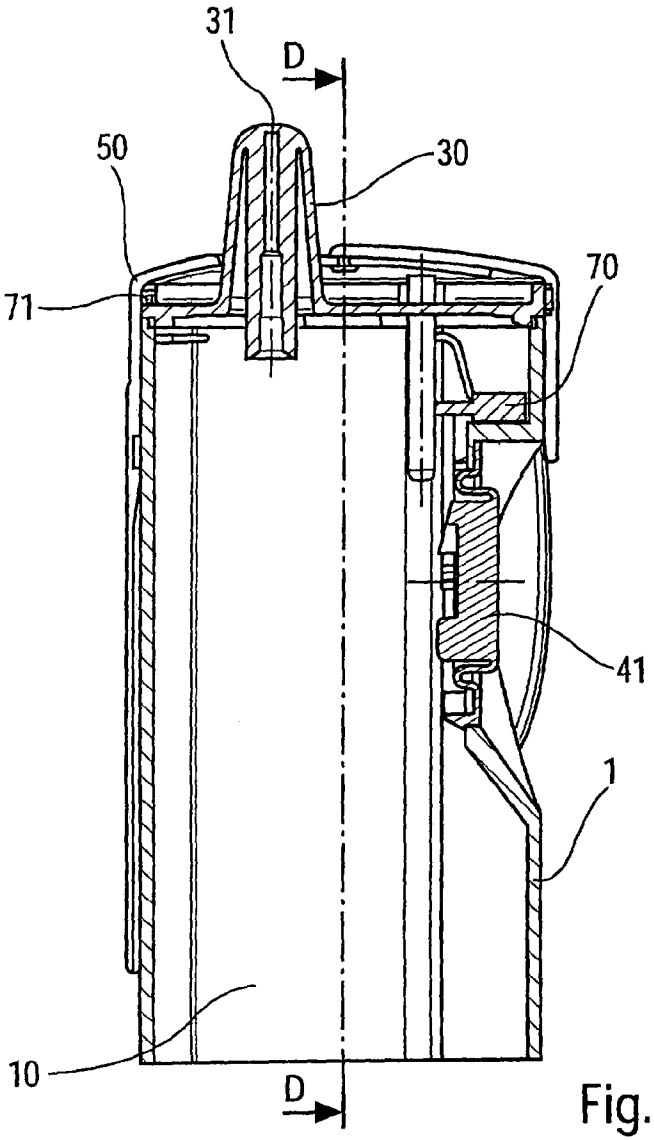
FIG. 9 is a view similar to the FIG. 7 view, with the cap in the in-use position.

FIGS. 4 to 6 show another variant embodiment of the invention, in which, when the cap 50 is in the rest position, it covers the actuating system 40, thereby preventing the user from accessing said actuating system 40. Thus, when the cap 50 is in the rest position, it is impossible to actuate the actuating system 40, and thus to actuate the pump 20. Simultaneously, the dispensing orifice 31 is protected by said cap 50. In the example shown in FIGS. 4 to 6, the cap 50 includes a substantially cylindrical body 51 that, when the cap is in its rest position, surrounds the dispensing head 30 and the actuating system 40 which, in this example, is a side actuating system comprising a side actuating element or button 41 on which the user must press to actuate the pump. Advantageously, said cap 50 includes a side wall 53 which receives said side actuating element 41 when the cap 50 is in the rest position, as shown in FIG. 4. The cap 50 also advantageously includes a cover 52 which is mounted to move relative to said body 51, preferably such that it opens automatically to uncover the dispensing orifice 31 when the user moves the cap 50 towards its in-use position. Thus, with reference to FIGS. 4 and 5, it can be seen that, when the user moves the cap 50 out of its rest position shown in FIG. 4, the moving cover 52 co-operates with the dispensing head 30 by being opened progressively thereby as it moves towards its in-use position. This is obtained in particular because, in this embodiment, the cap 50 moves in rotation about the dispensing head 30 and about said actuating system 40, this movement in rotation causing said cap 50 to be moved axially relative to said dispensing head 30. This may advantageously be achieved by means of ribs and/or grooves provided on or in the inside wall of the body 51 of the cap 50, and co-operating with corresponding ribs and/or grooves provided on or in the body 1 of the fluid dispenser device, as can be seen in FIGS. 4 to 6. Thus, the user moves the cap 50 in rotation, thereby causing said cap to be moved axially downwards relative to said head, so that said head 30 comes to push the cover 52 into the open position shown in FIG. 6. Once again, the cap may be turned in either direction, and either the cap, or the body of the dispenser, or indeed both of them may be turned to move said cap in rotation. In the in-use position shown in FIG. 6, the actuating element 41 is accessible to the user, and the dispensing head 30 is uncovered, so that the user can actuate the pump 20 and dispense a dose of fluid.

FIGS. 7 to 10 show another embodiment of the invention, in which the dispensing means 20 are electrostatic or piezoelectric spray means that are controlled electronically. The actuating system 40 comprises an actuating button 41, advantageously disposed on one side of the body 1. Locking elements 80, such as tabs lock said actuating button 41. These tabs 80 can be moved electronically from the locking position shown in FIG. 8 to the release position shown in FIG. 10. This movement and optionally the reverse movement is controlled by electronic means 70 advantageously connected to a contactor 71. This contactor 71 comes into contact with the captive cap 50 when said cap reaches its in-use position, thereby deactivating said locking tabs 80, and moving them into their release position. The user can then actuate the actuating button 41 to dispense a dose of fluid. When the cap 50 is returned to its rest position, there is no longer any contact between the cap 50 and the contactor 71, and the tabs 80 return to their locking position. Naturally, variant embodiments may be imagined, it being possible to implement the locking of the device in any manner, provided that the cap 50 deactivates the locking when it is in the in-use position.

In all of the embodiments described above, the cap 50 may include resilient return means that return it to its rest position after the device has been used. In a variant, it is possible to imagine that the user manually returns said cap to its rest position. Moreover, the invention is described above with reference to liquid or powder dispenser devices in which the dispensing direction is axial relative to the central axis of the pump and of the reservoir, but it is equally applicable to all types of dispenser device, and in particular to those that include a dispensing head having a radial dispensing direction. Furthermore, although the present invention is particularly well suited to liquid or powder dispenser devices having side actuating systems, it is not limited to this type of system, and indeed it is applicable to all suitable types of actuating system.

Although the invention is described above with reference to various particular embodiments of it, it is to be understood that it is not limited to these embodiments, and that the person skilled in the art may make any appropriate modifications without going beyond the ambit of the present invention as defined in the accompanying claims.

What is claimed is:

1. A manually-actuated device for dispensing a fluid in liquid or powder form and that comprises a fluid reservoir (10), dispensing means (20) for selectively dispensing the fluid contained in the reservoir (10), a dispensing head (30) provided with a dispensing orifice (31), and an actuating system (40) for manually actuating said dispensing means (20), said device being provided with a cap (50) mounted to move between a rest position, in which it covers the dispensing orifice (31) and prevents the dispensing means (20) from being actuated, and an in-use position, in which it uncovers the dispensing orifice (31) and enables the dispensing means (20) to be actuated, characterized in that said cap (50) is a captive cap and is independent from the actuating system (40) and wherein said cap (50) is moved axially in translation and in rotation relative to said dispensing head (30).

2. A device according to claim 1, in which said device is provided with locking means (60) for locking the dispensing means (20), which locking means prevent said dispensing means (20) from being actuated, said cap (50) moving and/or deforming said locking means (60) when it is moved into its in-use position to enable the dispensing means (20) to be actuated.

3. A device according to claim 2, in which said locking means (60) are resilient tabs (60) which, when the cap (50) is in the rest position, prevent the dispensing head (30) and the reservoir (10) from moving relative to each other, said tabs (60) being deformed by the cap (50) when it is in the in-use position.

4. A device according to claim 1, in which said cap (50) comprises a substantially cylindrical body (51) that surrounds the dispensing head (30) when the cap is in the rest position, and a cover (52) mounted to move relative to said body (51), said cover (52) being opened by the user firstly to uncover the dispensing orifice (31), and secondly to move said cover (50) into its in-use position.

5. A device according to claim 1, wherein the cap comprises one or more projections or one or more grooves that cooperate with additional one or more projections or one or move grooves of the dispensing device.

6. A device according to claim 1, in which, when the cap (50) is in the rest position, it covers the actuating system (40), thereby preventing access to said actuating system (40).

7. A device according to claim 6, in which said cap (50) comprises a substantially cylindrical body (51) which, when the cap is in the rest position, surrounds the dispensing head (30) and the actuating system (40), and a cover (52) mounted to move relative to said body (51), said cover (52) opening automatically to uncover the dispensing orifice (31) when the user moves said cap (50) towards its in-use position.

8. A device according to claim 7, in which said cap (50) is moved in rotation about said dispensing head (30) and about said actuating system (40), this movement in rotation causing said cap (50) to be moved axially relative to said dispensing head (30).

9. A device according to claim 6, in which said actuating system (40) comprises a side actuating element (41), said cap (50) having a side wall (53) covering said side actuating element (41) when said cap is in the rest position.

10. A device according to claim 1, in which said dispensing means (20) are implemented in the form of a pump that is actuated manually.

11. A device according to claim 1, in which said dispensing means (20) comprise piezoelectric or electrostatic spray means, the device including electronic means (70) for enabling and/or for disabling actuation of said dispensing means (20), said electronic means (70) being activated and/or deactivated by said cap (50).

12. A device according to claim 11, in which locking elements (80) cooperate with the actuating system (40), said locking elements (80) being mounted to move between an locking position and a release position, and being moved between these positions by said electronic means (70).

13. A device according to claim 12, in which said locking elements are tabs (80) for locking the actuating button (41) of the device, said electronic means (70) comprising a contactor (71) that comes into contact with the captive cap (50) when said cap is in the in-use position, said contactor (71) causing said tabs (80) to move into their release position when it is contact with said captive cap.

14. A device according to claim 1, further comprising a dispensing body and wherein the cap comprises slanting ribs or grooves which cooperate with corresponding ribs or grooves in the dispensing body so as to allow simultaneous movement of the cap in rotation and translation.

15. A manually-actuated device for dispensing a fluid in liquid or powder form and that comprises a fluid reservoir (10), dispensing means (20) for selectively dispensing the fluid contained in the reservoir (10), a dispensing head (30) provided with a dispensing orifice (31), and an actuating system (40) for manually actuating said dispensing means (20), said device being provided with a cap (50) mounted to move between a rest position, in which it covers the dispensing orifice (31) and prevents the dispensing means (20) from being actuated, and an in-use position, in which it uncovers the dispensing orifice (31) and enables the dispensing means (20) to be actuated, characterized in that said cap (50) is a captive cap and is independent from the actuating system (40);

in which when the cap (50) is in the rest position, it covers the actuating system (40), thereby preventing access to said actuating system (40);

in which said cap (50) comprises a substantially cylindrical body (51) which, when the cap is in the rest position, surrounds the dispensing head (30) and the actuating system (40), and a cover (52) mounted to move relative to said body (51), said cover (52) opening automatically to uncover the dispensing orifice (31) when the user moves said cap (50) towards its in-use position; and in which said cap (50) is moved in rotation about said dispensing head (30) and about said actuating system (40), this movement in rotation causing said cap (50) to be moved axially relative to said dispensing head (30).

* * * * *